US006307315B1

(12) United States Patent
Park et al.

(10) Patent No.: US 6,307,315 B1
(45) Date of Patent: Oct. 23, 2001

(54) CATHODE RAY TUBE

(75) Inventors: Duk-sung Park, Suwon; Sang-kyun Kim, Seoul, both of (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/158,196

(22) Filed: Sep. 22, 1998

(30) Foreign Application Priority Data

Sep. 24, 1997 (KR) ..... 97-48553

(51) Int. Cl.[7] ..... H01J 29/48
(52) U.S. Cl. ..... 313/479; 313/450; 313/313
(58) Field of Search ..... 313/414, 477 R, 313/479, 446–450

(56) References Cited

U.S. PATENT DOCUMENTS 2,509,763 5/1950 De Gier .
3,962,599 6/1976 Say .
4,885,503 12/1989 Takahashi et al. .
5,202,606 * 4/1993 Vrijssen et al. ..... 313/450
5,721,469 * 2/1998 Kim et al. ..... 313/446

FOREIGN PATENT DOCUMENTS 220857 4/1942 (CH) .

OTHER PUBLICATIONS

Patent Abstracts of Japan, vol. 010, No. 069 (E–389), Mar. 18, 1986; JP 60 218746, Nov. 1, 1985.

* cited by examiner

*Primary Examiner*—Michael H. Day
*Assistant Examiner*—Matthew T. Gerike
(74) *Attorney, Agent, or Firm*—Lowe Hauptman; Gilman & Berner, LLP

(57) ABSTRACT

A cathode ray tube includes a bulb having a screen, a conductive layer coated on the inner surface of the bulb, an electron gun mounted in the neck portion and having a final accelerating electrode electrically connected to the conductive layer, and leakage current shielding means installed in the neck portion, for shielding leakage current flowing along the inner surface of the neck portion from the conductive layer.

3 Claims, 3 Drawing Sheets

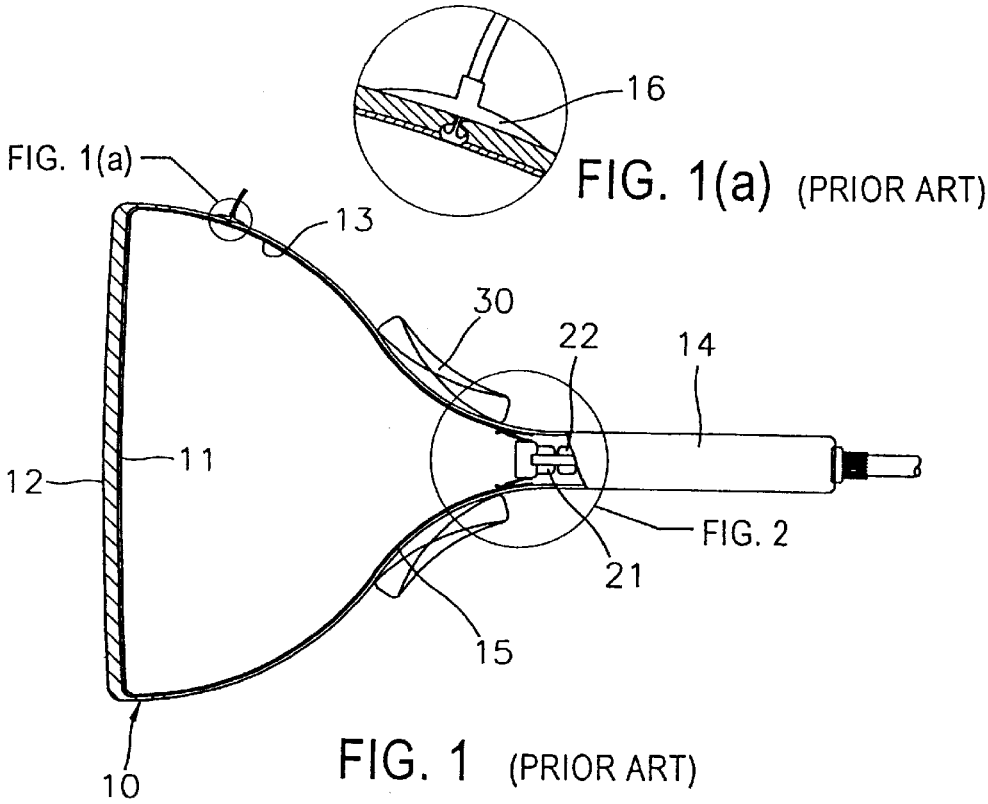
FIG. 1 (PRIOR ART)
FIG. 2
(PRIOR ART)
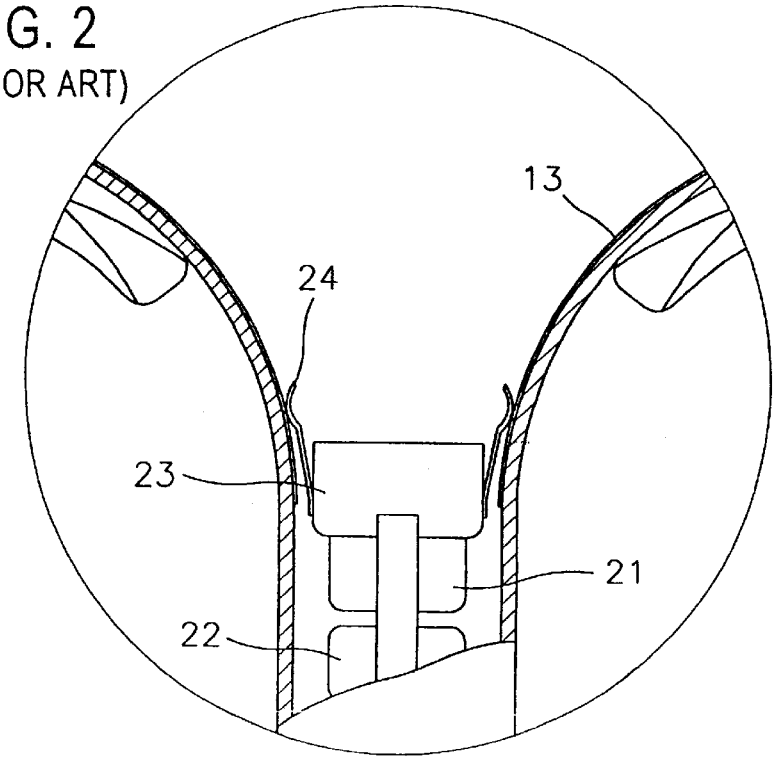

CATHODE RAY TUBE

BACKGROUND OF THE INVENTION

1. Field of the Invention

The present invention relates to a cathode ray tube (CRT), and more particularly, to a CRT having an improved mounting structure of an electron gun in a neck portion of the CRT.

2. Description of the Related Art

FIGS. 1 and 2 show a conventional CRT using the principle of a triode. As shown, the CRT includes a bulb 10 having a screen 12 coated with a fluorescent layer 11 on its inner surface, a conductive layer 13 coated on the inner surface of portions other than a neck portion 14 of the bulb 10, an electron gun 20 mounted in the neck portion 14 of the bulb 10 and having at least one final accelerating electrode 21 and a focusing electrode 22, and a deflection yoke 30 mounted on a cone portion 15 of the bulb 10. A high voltage of 25~29 kV is applied to the conductive layer 13 through an anode port 16 installed in the bulb 10.

Referring to FIG. 2 showing the neck portion 14 of the bulb 10, the conductive layer 13 is connected to a spacer 24 of a shield cup 23 fixed on the final accelerating electrode 21 of the electron gun 20 so that a high voltage is applied to the final accelerating electrode 21.

In the CRT having the aforementioned configuration, electron beams emitted from the electron gun 20 are selectively deflected by the deflection yoke 30 to excite phosphors of the fluorescent layer 11, thereby forming an image. During this process, excess thermions removed from the electron gun 20 but not used in exciting the phosphors are emitted to the outside through the conductive layer 13 and the anode port 16.

However, since the conductive layer 13 is not formed on the inner surface of the neck portion 14 into which the electron gun 20 is mounted, leakage current flows along the inner circumferential surface of the neck portion 14 due to the high voltage applied to the conductive layer 13. This leakage current adversely affects an electronic lens formed between electrodes in the electron gun 20. Further, if foreign matter is adsorbed into the inner circumferential surface of the neck portion 14, an arc discharge may occur between the foreign matter and the electrodes due to the leakage current.

In a projector for implementing a color image by projecting a monochrome image formed at unit CRTs for red, blue and green colors, a high-brightness image is required. To this end, it is necessary to apply a high voltage to a screen coated with a conductive layer and a fluorescent layer.

However, in the conventional CRT, as described above, leakage current may flow along the inner circumferential surface of a neck portion to break insulation, thereby causing discharge on the inner surface of the neck portion and the electrodes of the electron guns. Also, since the distance between a final accelerating electrode to which a high voltage is applied and a focusing electrode is as narrow as 1~2 mm, leakage current may flow through a bead glass to cause discharge.

To overcome the above-described problem, conventionally, high-resistance layers having different resistance values are sequentially coated on the inner circumferential surface of the neck portion to be used as a final accelerating electrode. In this case, however, coating the high-resistance layers is a difficult task.

SUMMARY OF THE INVENTION

To solve the above problems, it is an objective of the present invention to provide a cathode ray tube having means for preventing leakage current due to a high voltage applied to a conductive layer from flowing along the inner circumferential surface of a neck portion.

Accordingly, to achieve the above objective, there is provided a cathode ray tube including a bulb having a screen, a conductive layer coated on the inner surface of the bulb, an electron gun mounted in the neck portion and having a final accelerating electrode electrically connected to the conductive layer, and leakage current shielding means installed in the neck portion, for shielding leakage current flowing along the inner surface of the neck portion from the conductive layer.

The leakage current shielding means includes an annular fixing portion fixed on the inner surface of the neck portion, and an inner glass having a cylindrical supporting portion spaced apart from the inner surface of the neck portion and extending axially from the fixing portion.

Also, the conductive layer is coated up to the final accelerating electrode along the inner surface of the fixing portion and supporting portion so as to be electrically connected to the final accelerating electrode.

Also, there is provided a cathode ray tube comprising: a bulb having a screen; a conductive layer coated on the inner surface of the bulb; an electron gun mounted in the neck portion and having a final accelerating electrode electrically connected to the conductive layer; and an insulator installed between the final accelerating electrode of the electron gun and the inner surface of the neck portion.

BRIEF DESCRIPTION OF THE DRAWINGS

The above objective and advantages of the present invention will become more apparent by describing in detail preferred embodiments thereof with reference to the attached drawings in which:

FIG. 1 is a cross-sectional view illustrating a conventional CRT;

FIG. 2 is an enlarged cross-sectional view illustrating showing a neck portion shown in FIG. 1;

DESCRIPTION OF THE PREFERRED EMBODIMENTS

Figure 3:
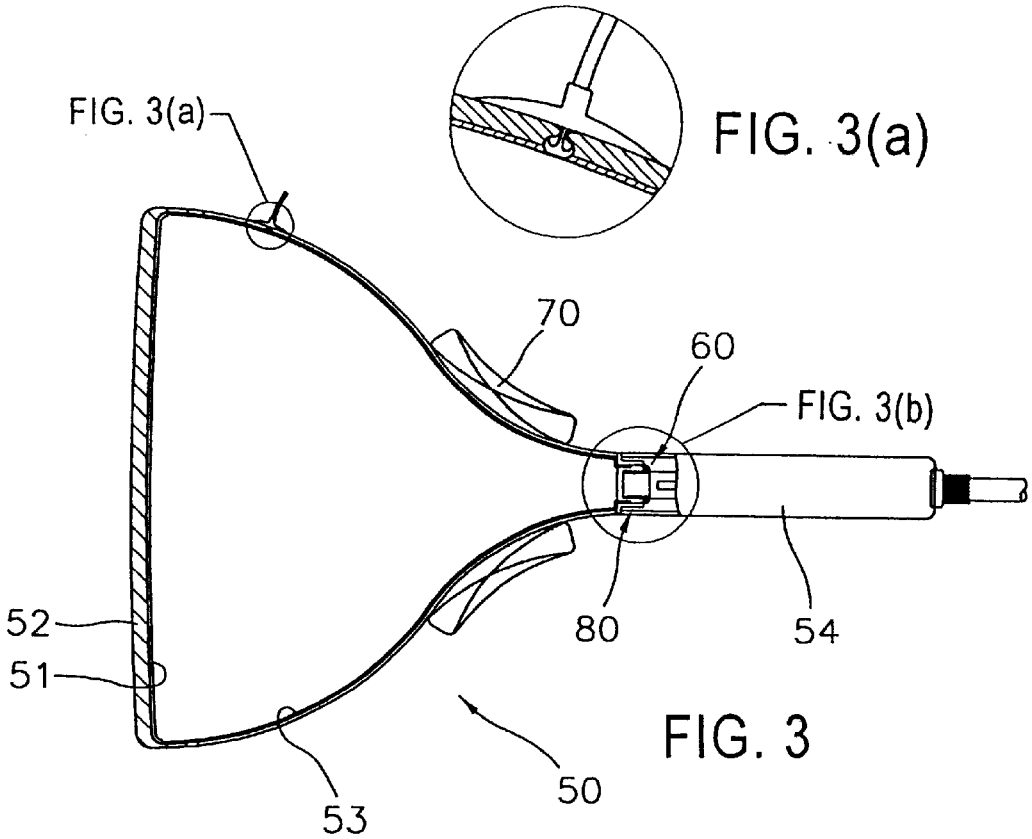
FIG. 3 is a cross-sectional view illustrating a CRT according to the present invention.
Figure 3B:
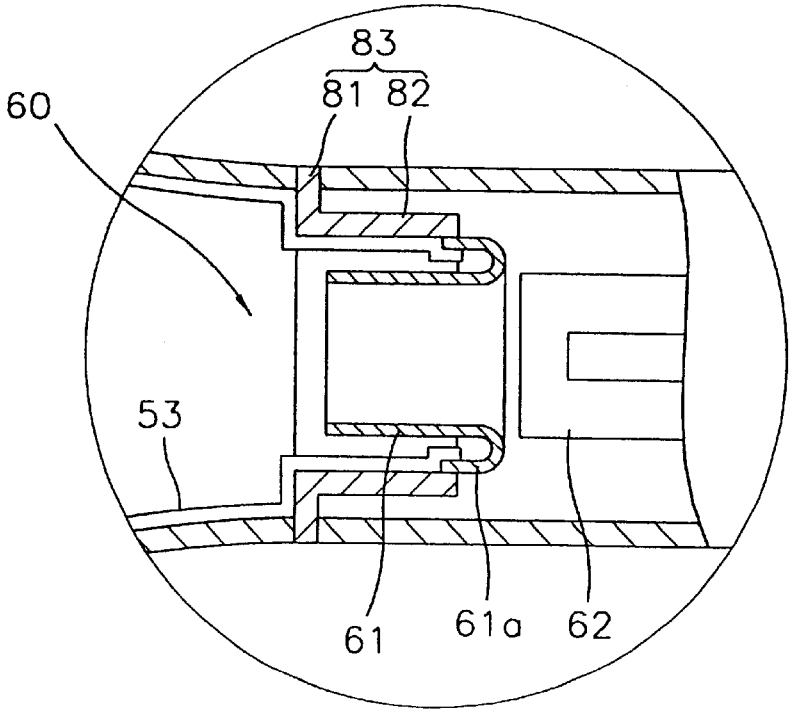

Referring to FIG. 3, the CRT according to a preferred embodiment of the present invention includes a bulb 50 having a screen 52 coated with a fluorescent layer 51 and a conductive layer 53 coated on its inner surface, an electron gun 60 hermetically mounted in a neck portion 54 of the bulb 50, and a deflection yoke 70 mounted on a cone portion of the bulb 50.

The electron gun 60 includes a final accelerating electrode 61 electrically connected to the conductive layer 53 and a focusing electrode 62 installed adjacent to the final accelerating electrode 61 and forming a main lens.

Also, there is provided leakage current shielding means within the neck portion 54 at the boundary between an area where the conductive layer 53 is coated and an area where the conductive layer 53 is not coated. The leakage current shielding means is for shielding leakage current flowing along the inner circumferential surface of the neck portion 54 due to a high voltage applied to the conductive layer 53.

Figure 4:
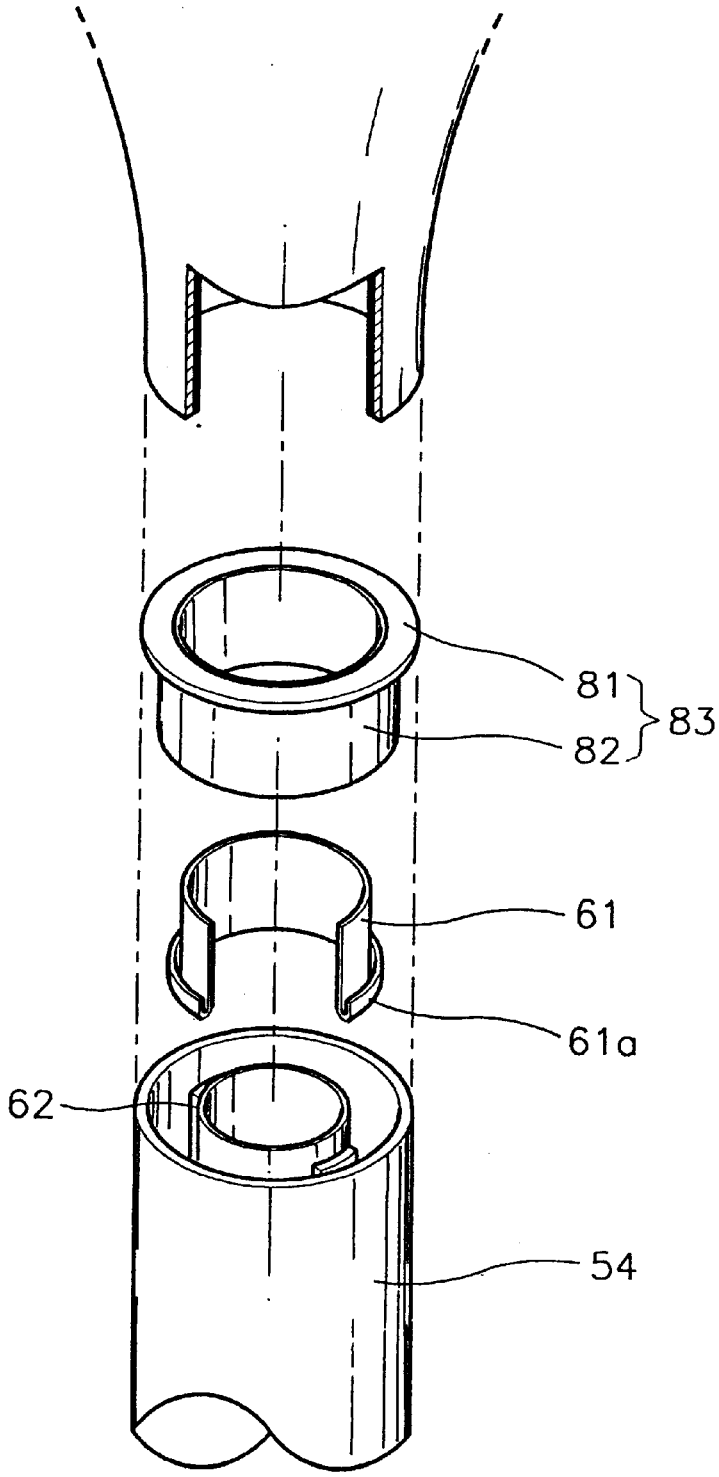
FIG. 4 is an exploded perspective view showing leakage current shielding means installed in a neck portion of the CRT according to the present invention, and electrodes of an electron gun.

As shown in FIGS. 3 and 4, the leakage current shielding means includes an annular fixing portion 81 fixed on the inner surface of the neck portion 54 and an inner glass 83 having a cylindrical supporting portion 82 spaced apart from the inner surface of the neck portion 54 and extended axially. The final accelerating electrode 61 of the electron gun is inserted into the supporting portion 82 to be supported. Also, the neck portion 54 is cut and the fixing portion 81 is connected to the cutting portion so that the inner glass 83 is connected to the neck portion 54.

Preferably, a bent portion 61*a* bent outwardly is formed at the end of the focusing electrode side of the final accelerating electrode 61. The bent portion 61*a* is connected to the inner surface of the supporting portion 82.

Also, the conductive layer 53 is extended to the bent portion 61*a* of the final accelerating electrode 61 along the inner surface of the fixing portion 81 and supporting portion 82. The electrical connection between the conductive layer 53 and the final accelerating electrode 61 is not restricted to the above-described embodiment and may be attained by installing a separate conductive layer or a conductive member for connecting the conductive layer 53 and the final accelerating electrode 61.

Preferably, the leakage current shielding means comprises an insulator (not shown) between the final accelerating electrode 61 and the inner surface of the neck portion 54. Here, the insulator may have a cylindrical shape, and one end of the cylindrical insulator is fixed to one side of the neck portion 54.

In the color CRT having the aforementioned configuration according to the present invention, the electron beams emitted from the electron gun 60 is selectively deflected by a deflection yoke and scanned onto the fluorescent layer 51 to excite the phosphors, thereby forming an image. Also, excess thermions landing on the phosphors are exhausted to the outside through the conductive layer to which a high voltage is applied and an anode port. During this process, the leaking current flowing along the inner surface of the neck portion due to a high voltage applied to the conductive layer is shielded by the inner glass 83.

In other words, since the inner surface of the neck portion 54 and the conductive layer 53 are spaced apart from each other by the inner glass 83, there is no possibility that the leakage current flows from the conductive layer 53 to the inner surface of the neck portion 54 or to the focusing electrode 62.

Thus, since a high voltage can be applied to the screen 52 and the conductive layer 53 with leakage current shielded, the current density of the electron beams emitted from the electron gun can be comparatively reduced. This improves the focusing characteristics of the electron gun, and prolongs the life of a fluorescent layer and the life of an electron emission source of the electron gun.

Although the present invention has been described through preferred embodiments, the embodiments are only illustrative and various alterations and modifications will readily occur to those skilled in the art within the spirit and scope of the invention. Also, the invention can be applicable to a color monitor for the CRT having been described above or a television receiver.

What is claimed is:

1. A cathode ray tube, comprising:

a bulb having a screen and a neck portion;

a conductive layer coated on an inner surface of the bulb;

an electron gun mounted in the neck portion and having final accelerating electrode electrically connected to the conductive layer; and a leakage current shielding arrangement installed in the neck portion, for shielding leakage current flowing along an inner surface of the neck portion from the conductive layer, and wherein the leakage current shielding arrangement is installed at a boundary between an area of conductive layer coating and an area lacking conductive layer coating.

2. The cathode ray tube according to claim 1 wherein the leakage current shielding arrangement comprises:

an annular fixing portion fixed on the inner surface of the neck portion; and an inner glass having a cylindrical supporting portion spaced apart from the inner surface of the neck portion and extending in the length direction of the neck portion from the annular fixing portion.

3. The cathode ray tube according to claim 2, wherein the conductive layer is coated up to the final accelerating electrode along an inner surface of the fixing portion and supporting portion so as to be electrically connected to the final accelerating electrode.

* * * * *